US006706120B2

(12) United States Patent
Miyauchi et al.

(10) Patent No.: US 6,706,120 B2
(45) Date of Patent: Mar. 16, 2004

(54) METHOD OF FIXING FLAVORANT WHICH IMPROVES SIDESTREAM SMOKE SMELL OF TOBACCO AND CIGARETTE

(75) Inventors: Masato Miyauchi, Yokohama (JP); Hideki Nagae, Yokohama (JP); Hiroshi Tanabe, Yokohama (JP); Hiroaki Nakano, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 36 days.

(21) Appl. No.: 10/073,420

(22) Filed: Feb. 13, 2002

(65) Prior Publication Data

US 2002/0074007 A1 Jun. 20, 2002

Related U.S. Application Data

(63) Continuation of application No. PCT/JP00/05648, filed on Aug. 23, 2000.

(30) Foreign Application Priority Data

Aug. 31, 1999 (JP) ..... 11-245290

(51) Int. Cl.[7] ..... A24B 15/30; D21H 27/00

(52) U.S. Cl. ..... 131/276; 131/274; 131/365; 162/139

(58) Field of Search ..... 131/274, 365, 131/275, 276, 277; 162/139

(56) References Cited

U.S. PATENT DOCUMENTS 4,804,002 A 2/1989 Herron
5,144,964 A 9/1992 Demain
5,479,949 A 1/1996 Battard et al.
5,947,127 A * 9/1999 Tsugaya et al. ..... 131/332

FOREIGN PATENT DOCUMENTS

JP 59-65 A 1/1984
JP 5-111372 A 5/1993
JP 5-236930 A 9/1993
JP 6-225745 A 8/1994
JP 8-289925 A 11/1996
JP 9-28366 A 2/1997
JP 09-028366 * 2/1997

* cited by examiner

*Primary Examiner*—Dionne A. Walls
(74) *Attorney, Agent, or Firm*—Birch, Stewart, Kolasch & Birch, LLP

(57) ABSTRACT

A method of fixing a flavorant for improving the small of a sidestream smoke of tobacco. This method includes applying, to tobacco wrapper paper, a tobacco sidestream smoke smell-improving agent including an ethanol or propylene glycol solution of the flavorant added to an emulsion of an ethylene-vinyl acetate copolymer having an ethylene content of 30% by weight or less, the emulsion having a solid content of 10 to 60% by weight, and drying it to fix the flavorant to the wrapper paper. The ethanol solution of the flavorant is added to the emulsion such that an amount of ethanol is 40% by weight or less with respect to 100% by weight of the emulsion, while the propylene glycol of the flavorant is added to the emulsion such that an amount of propylene glycol is 11% by weight or less with respect to 100% by weight of the emulsion.

10 Claims, 2 Drawing Sheets

METHOD OF FIXING FLAVORANT WHICH IMPROVES SIDESTREAM SMOKE SMELL OF TOBACCO AND CIGARETTE

CROSS-REFERENCE TO RELATED APPLICATIONS

This is a Continuation Application of PCT Application No. PCT/JP00/05648, filed Aug. 23, 2000, which was not published under PCT Article 21 (2) in English.

This application is based upon and claims the benefit of priority from the prior Japanese Patent Application No. 11-245290, filed Aug. 31, 1999, the entire contents of which are incorporated herein by reference.

BACKGROUND OF THE INVENTION

1. Field of the Invention

The present invention relates to a method of fixing a flavorant which improves the smell of sidestream smoke of tobacco, as well as a cigarette, and more specifically, to a method of effectively fixing a flavorant on a tobacco wrapper paper without substantially modifying a flavorant to be fixed, as well as a cigarette.

2. Description of the Related Art

A number of flavorants are added to tobacco articles, such as cigarettes, to create various types of tastes and aromas of tobacco smokes. In general, many kinds of volatile flavorant are blended and added to tobacco articles to create a distinctive impression of an individual tobacco product. In recent years, to improve the smell of the sidestream smoke released to the ambient during smoking, it has been proposed to add, to cigarette paper, a flavorant that masks the unpleasant smell.

The flavorants, which are added to cigarette paper to improve the smell of the sidestream smoke, are required to have properties, including those properties that the flavor is not released undesirably to the site where the tobacco article is produced, that the flavorant is not transferred to other materials while the tobacco article is in storage, and yet that the flavorant is selectively released in the sidestream smoke during smoking in order to improve the smell of the sidestream smoke. In order to establish such a smell-improving technique, there must be provided a flavor-releasing agent which can suppress the volatilization of the flavorant to a low level, and is stable and non-volatile under production and storage conditions, and yet which releases the flavor by thermal decomposition or desorption during smoking.

As such a technique, Jpn. Pat. Domestic Announcement No. 2-501075 (U.S. Pat. No. 4,804,002) discloses a technique of convering a flavorant into its glycoside, and Jpn. Pat. Appln. KOKAI Publication No. 5-146285 (U.S. Pat. No. 5,144,964) and Jpn. Pat. Domestic Announcement No. 7-504080 (U.S. Pat. No. 5,479,949) disclose a technique of clathrating a flavorant by cyclodextrin.

Incidentally, it is strongly desired that the masking flavorants used to improve the smell of the sidestream smoke should be used while being blended with various kinds of volatile masking flavorants so as to assure the unique aroma of the smoke that each type of the tobacco products has, as in the case of the general flavorant discussed above. However, the masking flavorants solved by the above-described technique are restricted by the synthesizing method in the technique of converting into glycoside and by the physical conditions of the enclosing cavity in the clathrate technique with cyclodextrin. Further, these techniques cannot deal with blended flavorants.

On the other hand, the taste and smell of a cigarette are created by smoking it, and the generation mechanism of the taste and flavor is an aggregate of considerably complicated processes. For example, generation of smoke component by, e.g., chemical reactions such as combustion reaction and oxidization reaction, evaporation and a distillation process and delivery of a smoke component by a transfer process such as dilution, diffusion or filtration are interacted with each other. Therefore, if a novel compound or additive which has not been conventionally available is used as a flavorant-holding member (fixing medium), an unexpected byproduct may be created due to the above complicated processes, which may bring about a negative affect on the taste and aroma of the cigarette. As a result, a great deal of efforts may be required to remove the negative effect in order to produce satisfactory taste and flavor.

In summary, as a generally employable flavor-holding and fixing technique used in the production of tobacco articles, a technique which does not affect the generation and delivery of smoke components, that is, a flavor-fixing technique which does not use a novel compound or additive is desirable.

Therefore, firstly, it is an object of the present invention to provide a method of fixing flavorants which improve the smell of sidestream smoke of tobacco, such that the flavorants can be stably held on tobacco wrapper paper during storage and can release the flavor which improves the smell of the sidestream smoke during smoking.

A second object of the present invention is to provide a method of effectively fixing, to tobacco wrapper paper, existing flavorants for improving the smell of sidestream smoke without a special modification made to the flavorant.

BRIEF SUMMARY OF THE INVENTION

The inventors of the present invention carried out extensive studies in order to achieve the above objects, and have found that an emulsion of an ethylene-vinyl acetate copolymer (hereinafter referred to as "EVA"), if it has a specified range of ethylene contents, is very effective as a medium for fixing a flavorant(s) for improving the smell of sidestream smoke of the tobacco (hereinafter referred to also as "masking flavorant"), and there is no need then to effect special modifications (e.g., reactions with other compound, clathrations) to the flavorant. At the same time, they have also found that the solid content of the EVA emulsion influences the stable retention of the masking flavorant. Further, the inventors of the present invention have found that when a masking flavorant is added to an EVA emulsion, it is effective that the masking flavorant is added as an ethanol or propylene glycol solution, and, in that case, the amount of the ethanol or propylene glycol added as a solvent influences the stable retention of the masking flavorant. Then, they have accomplished the present invention by studying these factors.

Thus, according to the present invention, there is provided a method of fixing a flavorant for improving the smell of a sidestream smoke of tobacco, comprising the steps of: applying, to tobacco wrapper paper, a tobacco sidestream smoke smell-improving agent comprising an ethanol or propylene glycol solution of a flavorant for improving the smell of the sidestream smoke of tobacco added to an emulsion of an ethylene-vinyl acetate copolymer having an ethylene content of 30% by weight or less, the emulsion having a solid content of 10 to 60% by weight; and drying the improving agent to fix the flavorant to the wrapper paper with the ethylene-vinyl acetate, wherein the ethanol solution of the flavorant is added to the emulsion such that an amount of ethanol is 40 parts by weight or less with respect to 100 parts by weight of the emulsion, or the propylene glycol of the flavorant is added to the emulsion such that an amount of propylene glycol is 11 parts by weight or less with respect to 100 parts by weight of the emulsion.

Further, according to the present invention, there is provided a cigarette having a tobacco rod wrapped by tobacco wrapper paper to which a masking flavorant is fixed by the method of the present invention. In this case, it is most preferable that the EVA emulsion should be applied in the form of a seam adhesive at a seamed portion of the tobacco wrapper paper.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

BEST MODE FOR CARRYING OUT OF THE INVENTION

Figure 1:
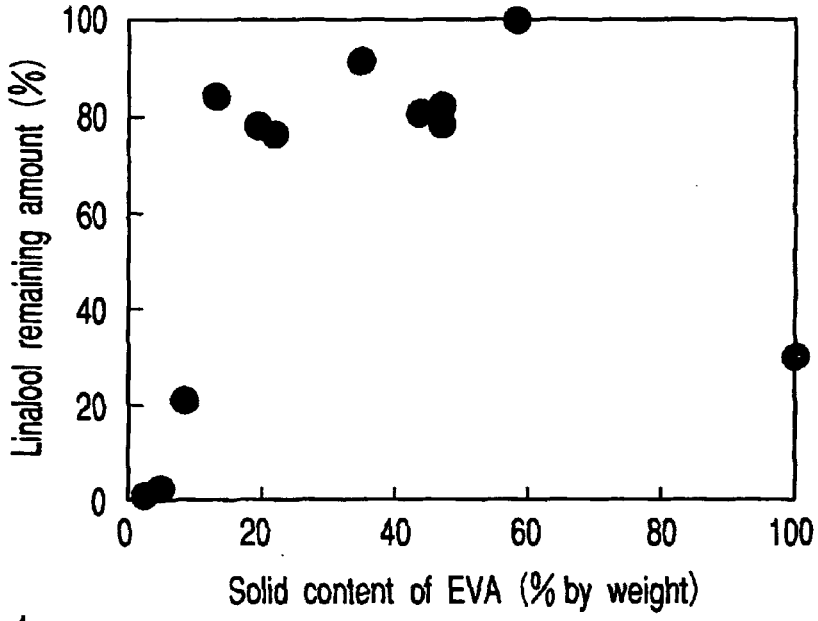
FIG. 1 is a graph illustrating the relationship between the solid content of an EVA emulsion and a remaining amount of a masking flavorant.

The present invention will now be described in more details.

The present invention is basically a technique of fixing a masking flavorant with EVA by adding the masking flavorant in the form of an ethanol or propylene glycol solution to an EVA emulsion (usually aqueous emulsion), applying the resultant mixture (tobacco sidestream smoke smell-improving agent) to tobacco wrapper paper and then drying the mixture. As the mixture is dried, a surface barrier layer (made of EVA which retains the masking flavor) is formed, which suppresses volatilization of the masking flavorant.

In the present invention, an EVA used as a fixing medium for the masking flavorant has an ethylene content of 30% by weight or less. If the ethylene content exceeds 30% by weight, a sufficient fixing effect cannot be exhibited. The lower limit of the ethylene content of the EVA is usually 0.01% by weight. An EVA emulsion used in the present invention can be employed as a seam adhesive used in a high-speed cigarette-making machine. It should be noted that the ethylene content of the EVA used should preferably be low, and more preferably, it should be 8% by weight or lower. Further preferably, the EVA has an ethylene content of 0.01% by weight to 7% by weight.

In the present invention, the EVA emulsion has a solid (EVA) content within a range of 10 to 60% by weight. If the solid content is less than 10% by weight, the amount of EVA, the solid component, becomes insufficient, resulting in that the masking flavorant cannot be sufficiently held and fixed. On the other hand, when the solid content exceeds 60% by weight, a sufficient flowability of the EVA emulsion cannot be achieved, and therefore a dense barrier layer cannot be formed. The EVA emulsion should preferably have a solid content within a range of 15 to 55% by weight.

In the present invention, the masking flavorant fixed by the EVA emulsion is not limited particularly as long as the flavorant is of a type which can be used normally as a masking flavorant, and it can be used as it is without any modification. Examples of such a masking flavorant are terpenes, esters, alcohols such as linalool, nerol and geraniol, phenols including anethole, aldehydes such as vanilline and ethyl vanilline, lactones, and plant and fruit extracts. They can be used singly or in the form of a mixture (blended flavorants) as desired.

In the present invention, tobacco wrapper paper serving as a substrate on which a masking flavorant is fixed is wrapper paper for paper-wrapped tobacco (cigarette), and any wrapper papers that are usually employed can be used.

In order to fix a masking flavorant on a wrapper paper according to the present invention, firstly, one or more masking flavorants are added in the form of ethanol or propylene glycol solution to an EVA emulsion. In the case where ethanol is used as a solvent, the ethanol solution of the flavorant is added such that an amount of the ethanol solvent is 40 parts by weight or less with respect to 100 parts by weight of the EVA emulsion. The amount of ethanol added is usually 0.01 parts by weight or more. Preferably, the ethanol solution of the flavorant is added such that an amount of ethanol is 0.01 parts by weight to 10 parts by weight with respect to 100 parts by weight of the EVA emulsion. Meanwhile, in the case where propylene glycol is used as a solvent, the propylene glycol solution of the flavorant is added such that an amount of the propylene glycol is 11 parts by weight or less with respect to 100 parts by weight of the EVA emulsion. The amount of propylene glycol added is usually 0.01 parts by weight or more. Preferably, the propylene glycol solution of the flavorant is added such that an amount of propylene glycol is 0.01 parts by weight to 5 parts by weight with respect to 100 parts by weight of the EVA emulsion. If the amount of the respective solvent added exceeds the upper limit noted above, the fixing of the masking flavorant will be adversely affected, and it becomes difficult to apply it as a seam adhesive. The amount of the masking flavorant added should preferably be 0.001 to 30% by weight based on the weight of the EVA emulsion. After adding the solution of the masking flavorant, the resultant EVA emulsion is sufficiently mixed to uniform.

Then, the EVA emulsion to which the masking flavorant solution has been added (tobacco sidestream smoke smell-improving agent) is applied (coated) to tobacco wrapper paper. It has been found that in the application of the tobacco sidestream smoke smell-improving agent to the tobacco wrapper paper, the releasing rate of the flavorant into the sidestream smoke is significantly higher in the case where it is applied onto the outer surface of the wrapper paper than in the case where it is applied onto the inner surface (which is the surface on the cut tobacco side) of the wrapper paper. It should be noted here that the tobacco sidestream smoke smell-improving agent may be applied not on the entire surface of the wrapper paper, but applied as one or more lines on the paper in its longitudinal or lateral direction. However, since the tobacco sidestream smoke smell-improving agent of the present invention can be used as a seam adhesive as noted above, the tobacco sidestream smoke smell-improving agent can be put into an adhesive tank on a cigarette-making machine, and it can be directly used as the seam adhesive. With this, there is no need to remodel the existing facilities or to provide an additional device, but the existing facilities can be used as they are, so as to fix the masking flavorant on the wrapper paper and make cigarettes. In this manner, the increase in the cost can be suppressed.

After the tobacco sidestream smoke smell-improving agent is applied to the wrapper paper, it is dried. Usually, the drying can be effected at a temperature ranging from room temperature to 300° C. for 0.001 second to several minutes. When the tobacco sidestream smoke smell-improving agent is applied as the seam adhesive, the usual drying conditions for a conventional seam adhesive can be used.

The masking flavorant thus fixed on the wrapper paper by means of the EVA emulsion, when the amount of addition is low, does not generate aroma under ordinary tobacco articles production and storage conditions, but when smoked, it effectively release aroma so as to improve the smell of the tobacco sidestream smoke. In this respect, the present invention can be clearly distinguished from the aroma-releasing agent prepared by mixing a flavorant into a grain or pellet form of EVA. Further, in the present invention, there is no mutual interaction between the EVA and the flavorant.

A tobacco rod can be wrapped with wrapper paper to which the masking flavorant is fixed according to the present invention. A cigarette having this tobacco rod can be suppressed of unpleasant smell of the sidestream smoke during smoking.

It should be noted that the EVA emulsion to which the masking flavorant is added can be applied to a wrapper paper during wrapper paper-making processes.

Examples of the present invention will now be described; however the invention should not be limited to these Examples. In these Examples, an EVA having an ethylene content of 7% by weight was used.

EXAMPLE 1

In this example, a relationship between a solid content of an EVA emulsion and a aroma-retaining property was studied. EVA emulsions of various water contents, from 0% to 100%, were used in the test.

About 0.2 g of the respective EVA emulsion was put into a container having a gas inlet and a gas outlet, and an ethanol solution of linalool was added to the emulsion such that an amount of linalool became 1% by weight. Then, the container was placed in an air bath at a temperature of 80° C., and nitrogen gas was supplied from the gas inlet at a flow rate of 40 cc/min so as to dry the linalool-added EVA emulsion over a period of 24 hours. Thereafter, each of the dried samples was heated at 300° C. for one hour so as to desorb the linalool, and the concentration thereof (linalool remaining amount) was measured with a gas chromatography (GC). FIG. 1 shows the relationship between a solid content of the EVA emulsion and a linalool remaining amount of the respective dried sample. As can be seen from FIG. 1, in the case where a solid content of the EVA emulsion is in a range of 10 to 60% by weight, the linalool remaining amount significantly improves. When a solid content of the EVA emulsion exceeds 60% by weight, EVA is gelled and the surface barrier layer is not formed densely. On the other hand, when a solid content of the EVA emulsion is less than 10% by weight, the amount of the solid becomes insufficient, and therefore the surface barrier layer is not formed densely.

EXAMPLE 2

In this example, an influence of the amount of a solvent (ethanol or propylene glycol) added to EVA emulsion was studied.

Figure 2:
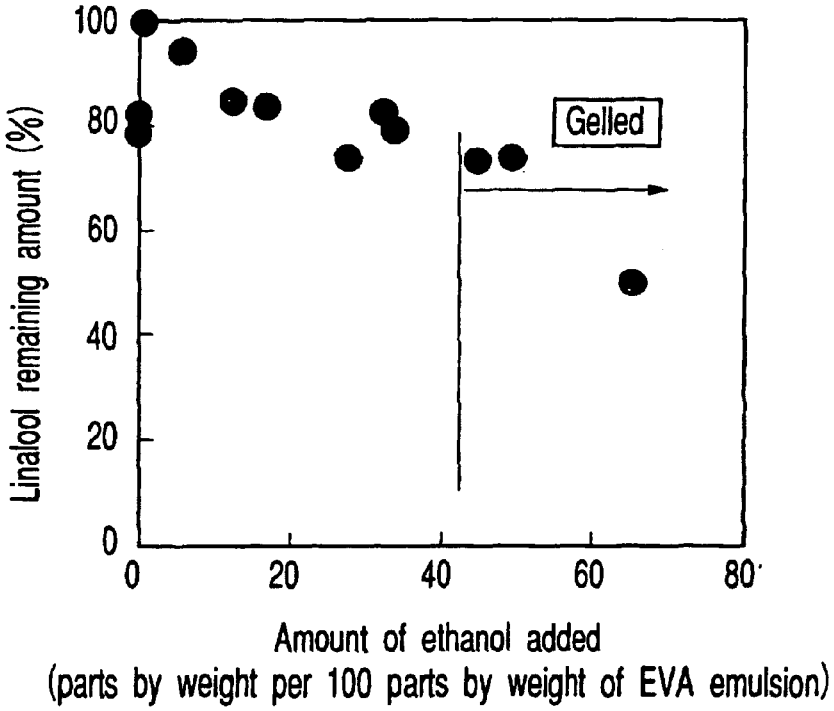
FIG. 2 is a graph illustrating an influence on an EVA emulsion by an addition of ethanol.
Figure 3:
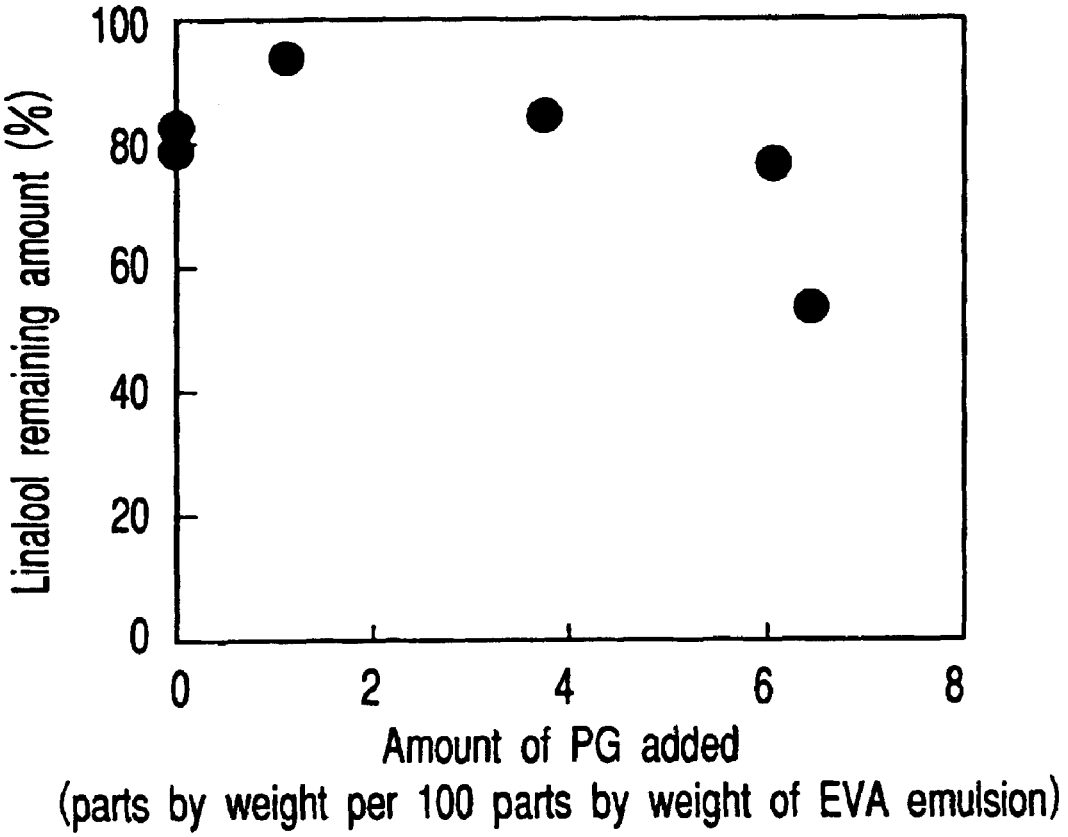
FIG. 3 is a graph illustrating an influence on an EVA emulsion by an addition of propylene glycol.

An ethanol or propylene glycol solution, in which linalool was dissolved, was added in various amounts to 100 parts by weight of an EVA emulsion (solid content of 47% by weight; water content of 53% by weight) such that the amount of linalool became 1% by weight (In any case, the amount of linalool was 1% by weight with respect to the total amount of the EVA emulsion and the linalool solution). Using the thus-obtained tobacco sidestream smoke smell-improving agents, similar tests to those of Example 1 were carried out to measure the linalool remaining amount (% by weight) in each case. The results are shown in FIG. 2 (in the case of the ethanol solution) and FIG. 3 (in the case of the propylene glycol solution). As can be seen from FIG. 3, in the case of using the ethanol solution, when an addition amount of ethanol as a solvent exceeds 40 parts by weight with respect to 100 parts by weight of the EVA emulsion, the linalool remaining amount decreases. This is because the EVA emulsion was gelled, and therefore a dense barrier layer was not formed. On the other hand, as can be seen from FIG. 4, in the case of using the propylene glycol (PG) solution, when the ratio of addition of ethanol as a solvent is 11 parts by weight or less with respect to 100 parts by weight of the EVA emulsion, the linalool remaining amount is stabilized.

EXAMPLE 3

The sidestream smoke smell-improving agents consisting of the EVA emulsions to which the linalool solutions were added, as prepared in Example 2, were used as seam adhesive, and cigarettes were made with tobacco wrapper paper using a cigarette-making machine. The amount of the seam adhesive added was 2 g at maximum per cigarette. In the case where the ethanol solution was used, when an addition amount of ethanol as a solvent exceeds 40 parts by weight with respect to 100 parts of the EVA emulsion, the EVA emulsion was gelled. On the other hand, in the case where the propylene glycol solution was used, when an addition amount of propylene glycol as a solvent exceeds 11 parts by weight with respect to 100 parts of the EVA emulsion, the seam adhesive could not be sufficiently dried, thereby causing adhesion failure of the wrapper paper.

It should be noted that in the above-described Examples, linalool was used as a masking flavorant; however, with other masking flavorants (such as ethyl vanillin and blended flavorant (mixture of 4 flavorant, namely, prune-based, honey-based, tea-based and fruity-based flavors), similar results were obtained.

As has been described above, according to the present invention, there is provided a method of fixing a flavorant for improving the smell of sidestream smoke of tobacco, by which the flavorant can be stably held on tobacco wrapper paper during storage, but can be released during smoking so as to improve the smell of sidestream smoke. Further, according to the present invention, existing flavorants for improving the smell of sidestream smoke can be effectively fixed to tobacco wrapper paper without special modifications made to the flavorants.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of fixing a flavorant for improving the smell of a sidestream smoke of tobacco, comprising the steps of: applying, to tobacco wrapper paper, a tobacco sidestream smoke smell-improving agent comprising an ethanol or propylene glycol solution of a flavorant for improving the smell of the sidestream smoke of tobacco added to an emulsion of an ethylene-vinyl acetate copolymer having an ethylene content of 30% by weight or less, said emulsion having a solid content of 10 to 60% by weight; and drying the tobacco sidestream smoke smell-improving agent so as to fix the flavorant to the wrapper paper with the ethylene-vinyl acetate, wherein the ethanol solution of the flavorant is added to the emulsion such that an amount of ethanol is 40% by weight or less with respect to 100% by weight of the emulsion, or the propylene glycol of the flavorant is added to the emulsion such that an amount of propylene glycol is 11% by weight or less with respect to 100% by weight of the emulsion.

2. The method according to claim 1, wherein the ethylene-vinyl acetate copolymer has an ethylene content of 8% by weight or less.

3. The method according to claim 1, wherein the ethylene-vinyl acetate copolymer has an ethylene content of 0.01 to 7% by weight.

4. The method according to claim 1, wherein the emulsion has a solid content of 15 to 55% by weight.

5. The method according to claim 1, wherein the flavorant is in the form of an ethanol solution.

6. The method according to claim 5, wherein the ethanol solution is added to the emulsion such that an amount of ethanol is 0.01 to 10 parts by weight with respect to 100 parts by weight of the emulsion.

7. The method according to claim 1, wherein the flavorant is in the form of an propylene glycol solution.

8. The method according to claim 7, wherein the propylene glycol solution is added to the emulsion such that an amount of propylene glycol is 0.01 to 5 parts by weight with respect to 100 parts by weight of the emulsion.

9. The method according to claim 1, wherein the flavorant is added to the emulsion such that an amount of the flavorant is 0.001 to 30% by weight with respect to the emulsion.

10. The method according to claim 1, wherein the flavorant is at least one ordinary flavorant which is unmodified.

* * * * *